US007130570B2

(12) United States Patent
Murakami et al.

(10) Patent No.: US 7,130,570 B2
(45) Date of Patent: Oct. 31, 2006

(54) TRANSFER DEVICE

(75) Inventors: Susumu Murakami, Soraku-gun (JP); Takahiro Fukunaga, Sakurai (JP); Yoshie Iwakura, Higashiosaka (JP); Kuniaki Nakano, Soraku-gun (JP); Hideshi Izumi, Ikoma (JP); Minoru Tomiyori, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 8 days.

(21) Appl. No.: 11/021,510

(22) Filed: Dec. 22, 2004

(65) Prior Publication Data

US 2005/0141930 A1 Jun. 30, 2005

(30) Foreign Application Priority Data

Dec. 26, 2003 (JP) ..... P2003-435395

(51) Int. Cl.
*G03G 15/01* (2006.01)

(52) U.S. Cl. ..... 399/302

(58) Field of Classification Search ..... 399/302, 399/299

See application file for complete search history.

(56) References Cited

U.S. PATENT DOCUMENTS

2003/0185602 A1* 10/2003 Sasamoto et al. ..... 399/299
2004/0179872 A1* 9/2004 Saito et al. ..... 399/302

FOREIGN PATENT DOCUMENTS

JP 10-039651 2/1998
JP 2001-075379 3/2001
JP 2003-091133 3/2003

* cited by examiner

*Primary Examiner*—Sandra L. Brase
(74) *Attorney, Agent, or Firm*—David G. Conlin; David A. Tucker; Edwards Angell Palmer & Dodge LLP

(57) ABSTRACT

A transfer device has a plurality of first transfer rollers provided, one in each of a plurality of first transfer regions. The first transfer rollers are arranged downstream of respective image carriers in a traveling direction of an intermediate transfer belt, so as to be out of contact with the image carriers through the belt. In the first transfer region that is located most upstream in the traveling direction, there is a pressure member provided upstream of the image carrier in the traveling direction for pressing the intermediate transfer belt against the image carrier.

3 Claims, 4 Drawing Sheets

TRANSFER DEVICE

CROSS REFERENCE

This Nonprovisional application claims priority under 35 U.S.C. § 119(a) on patent application Ser. No. 2003-435395 filed in Japan on Dec. 26, 2003,the entire contents of which are hereby incorporated by reference.

BACKGROUND OF THE INVENTION

The present invention relates to a transfer device for use in an electrophotographic image forming apparatus, and in particular to a transfer device for firstly transferring a toner image as formed on an image carrier to an endless intermediate transfer belt and secondly transferring the toner image from the intermediate transfer belt to a record medium such as a sheet of paper (hereinafter referred to merely as a sheet).

A full-color image forming apparatus forms an image, using a toner of color corresponding to each of a plurality of color image data obtained by color separation from an original color image. More specifically, the image forming apparatus reads the original full-color image through different color filters for the three additive primary colors—red, green, and blue—and produces color image data for the three subtractive primary colors—cyan, magenta, and yellow—and black, respectively. Based on each of the color image data, a developed image is created with a toner of corresponding color. Resulting developed images for the respective colors are accumulated to form a full-color image.

Japanese Patent Application Laid-Open No. H10-039651 discloses a tandem-type full-color image forming apparatus having a semiconductive endless belt and a plurality of (e.g. four) image forming sections. The endless belt is installed rotatably, and the image forming sections each provided for forming a developed image of corresponding color are aligned along an outer circumference of the endless belt. This arrangement allows a full-color image to be formed in at least one full rotation of the endless belt.

There is also known a tandem-type full-color image forming apparatus using an intermediate transfer method. In the image forming apparatus, developed images for the respective colors formed on photoreceptor drums as image carriers in respective image forming sections are accumulated on an outer circumferential surface of an endless belt (an intermediate transfer belt) and then transferred to a sheet, to form a full-color image.

More specifically, toner images are formed on the image carriers (photoreceptor drums) in the respective image forming sections, based on image data for the respective colors obtained by color separation. The toner images are firstly transferred from the photoreceptor drums to the intermediate transfer belt to be accumulated, or first transfer processes are performed. Then, the accumulation of toner images is secondly transferred from the intermediate transfer belt to the sheet, or a second transfer process is performed.

Accordingly, the formation of a full-color image involves the first transfer processes performed in a plurality of, for example four, first transfer regions, and the second transfer process performed in a second transfer region other than the first transfer regions. While following a loop path, the intermediate transfer belt passes through the first transfer regions and the second transfer region, in the order.

Conventionally, each of the first transfer regions has a transfer nip area formed as follows. A first transfer roller, which is flexible, is pressed against a circumferential surface of the photoreceptor drum, which is a rigid body, through the intermediate transfer belt. Part of a circumferential surface of the first transfer roller is thus deformed elastically along the circumferential surface of the photoreceptor drum, so that the intermediate transfer belt is brought into contact with the circumferential surface of the photoreceptor drum over a predetermined contact width to form a transfer nip area. The transfer nip area is provided for transferring a toner image in a stable manner from the outer circumferential surface of the photoreceptor drum to the intermediate transfer belt.

However, the transfer nip area as formed above causes various problems. Since the surface of the first transfer roller is more flexible than that of the photoreceptor drum, potential fluctuations in traveling speed of the intermediate transfer belt in the transfer nip area lead to an imbalance in peripheral speed between the intermediate transfer belt and the photoreceptor drum, thereby causing difficulty in proper transfer of a toner image. The fluctuations in traveling speed are likely to be caused by changes, with time or due to environmental changes, in coefficient of friction between the intermediate transfer belt and the photoreceptor drum.

Also, width of the transfer nip area needs to be increased in order to ensure that a toner image is transferred from the photoreceptor drum to the intermediate transfer belt. The intermediate transfer belt is thus pressed closely against the photoreceptor drum, so that part of toner particles are clumped together. When a toner image is transferred to a sheet, the clumped toner particles remain on the intermediate transfer belt, thereby causing a void, or absence of toner within a specified outline of a character or the like, in the transferred image on the sheet. This results in deterioration in image quality.

Besides, with the intermediate transfer belt pressed closely against the photoreceptor drum, toner residues originating upstream on the intermediate transfer belt are likely to be attracted to a photoreceptor drum positioned downstream. This results in undesirable mixture of toner of different colors, causing a discrepancy in color between an original image and an image as formed based thereon.

In view of the foregoing, Applicants have offered a transfer device as shown in FIG. 1. In the transfer device, first transfer rollers 13A to 13D are arranged in first transfer regions TA to TD, respectively, so as to be positioned downstream of respective transfer nip areas in a traveling direction of an intermediate transfer belt 11 as indicated by an arrow A. The first transfer rollers 13A to 13D are out of contact with photoreceptor drums 101A to 101D, respectively, through the intermediate transfer belt 11. The transfer nip areas are provided over a predetermined contact width in the traveling direction of the intermediate transfer belt 11 and the photoreceptor drums 101A to 101D, respectively. This arrangement prevents the fluctuations in traveling speed of the intermediate transfer belt 11 in the transfer nip areas, the deterioration in image quality caused by the clamped toner particles, and the mixture of toner of different colors. This arrangement also prevents wasteful consumption of toner.

In the transfer device as shown in FIG. 1, however, the transfer nip area in the first transfer region located most upstream on the intermediate transfer belt 11 in the traveling direction (or the most upstream first transfer region) has a width (or contact width in the traveling direction of the intermediate transfer belt 11 and the photoreceptor drum) narrower than those of the other transfer nip areas in the other first transfer regions.

A bottommost portion of a circumferential surface of a driven roller, which is arranged upstream of the most upstream first transfer region and over which the intermediate transfer belt 11 is stretched, is at a higher level than a bottommost portion of a circumferential surface of each of the first transfer rollers. Upstream of the photoreceptor drum in the most upstream first transfer region, therefore, the intermediate transfer belt 11 follows a path different from the one that the belt 11 follows upstream of the photoreceptor drums in the other three first transfer regions.

More specifically, the intermediate transfer belt 11 is approximately level in the first three transfer regions while the traveling path is slanted in the most upstream first transfer region.

The condition prevents the four first transfer regions from producing uniform transfer results, thereby causing a problem of deterioration in color image reproducibility.

In view of the foregoing, a feature of the present invention is to offer a transfer device having a constant contact width of an intermediate transfer belt and each of photoreceptor drums in each of a plurality of first transfer regions, or a constant transfer nip width. The construction of the device allows uniform transfer results to be achieved in the first transfer regions, thereby enhancing image reproducibility.

SUMMARY OF THE INVENTION

A transfer device includes an endless intermediate transfer belt following a loop path in a predetermined traveling direction; a plurality of image carriers; a plurality of first transfer rollers arranged in first transfer regions where the intermediate transfer belt is pressed by the first transfer rollers and brought into contact with the image carriers in order for a toner image to be firstly transferred from the image carriers to the intermediate transfer belt; a second transfer roller arranged in a second transfer region where the toner image is secondly transferred from the intermediate transfer belt to a record medium fed between the second transfer roller and the intermediate transfer belt, the second transfer region being provided downstream of the first transfer regions in the traveling direction; and a member for maintaining a constant contact width of the intermediate transfer belt and the image carriers in the respective transfer regions.

DETAILED DESCRIPTION OF THE INVENTION

Figure 1:
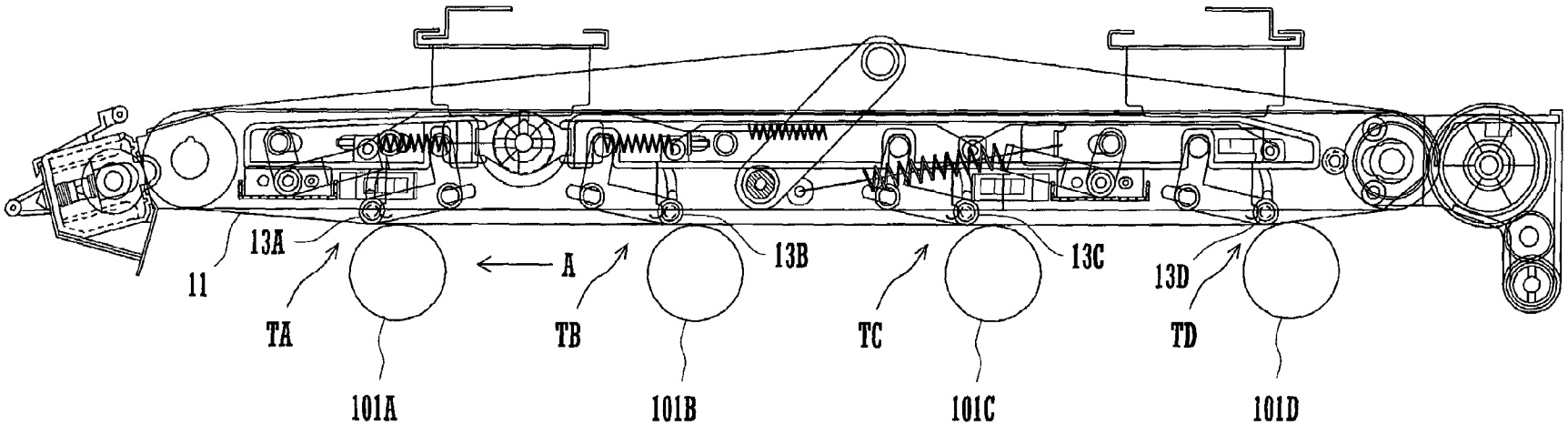
PRIOR ART FIG. 1
FIG. 1 is a front view illustrating a construction of a transfer device without a pressure member.
Figure 2:
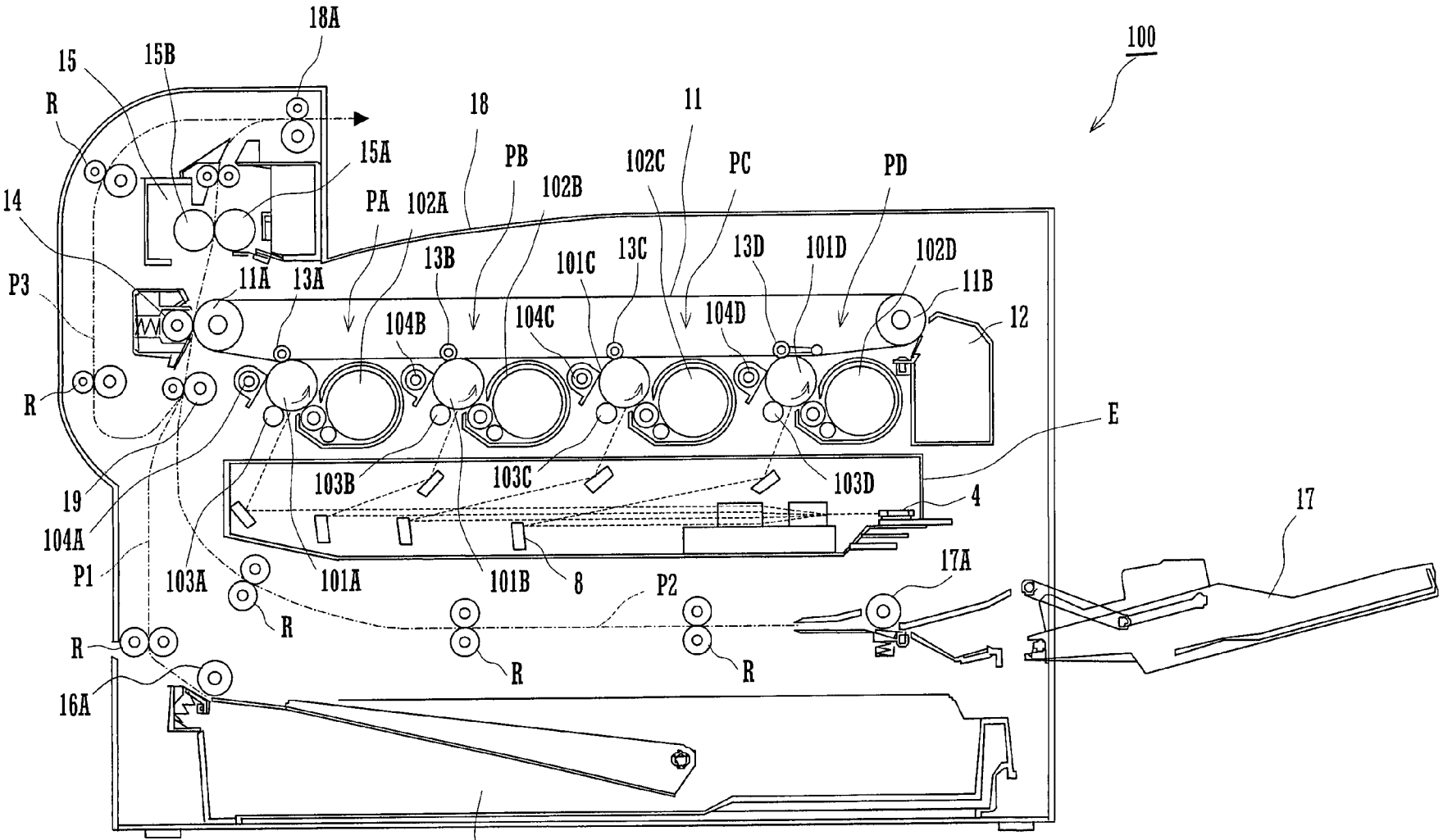
FIG. 2 is a cross-sectional view illustrating a construction of an image forming apparatus including a transfer device according to an embodiment of the present invention.

FIG. 2 is a cross-sectional view illustrating a construction of an image forming apparatus including a transfer device according to an embodiment of the present invention. An image forming apparatus 100 forms a multi-color or monochromatic image on a record medium such as a sheet of paper (hereinafter referred to merely as a sheet) based on image data transmitted externally. The image forming apparatus 100 has an exposure unit E, four photoreceptor drums 101A to 101D, four developing units 102A to 102D, four charging rollers 103A to 103D, four cleaning units 104A to 104D, an intermediate transfer belt 11, four first transfer rollers 13A to 13D, a second transfer roller 14, a fusing device 15, sheet transport paths P1, P2, and P3, a sheet feed cassette 16, a manual sheet feed tray 17, and a sheet catch tray 18.

The transfer device of the present invention includes the intermediate transfer belt 11, the first transfer rollers 13, and the second transfer roller 14.

The image forming apparatus 100 forms an image based on image data obtained by color separation from an original color image. The image data correspond to four colors, i.e. the three subtractive primary colors—yellow (Y), magenta (M), and cyan (C)—and black (K), respectively. There are four image forming sections PA to PD provided correspondingly to the four colors. The photoreceptor drums 101A to 101D, the developing units 02A to 102D, the charging rollers 103A to 103D, and the cleaning units 104A to 104B are provided, one each in each of the four image forming sections PA to PD. The image forming sections PA to PD are aligned along a direction in which the intermediate transfer belt travels (or a sub scanning direction).

The charging rollers 103A to 103D are contact-type chargers provided for charging an outer circumferential surface of each of the photoreceptor drums 101A to 101D uniformly so that the surface has a predetermined potential. The charging rollers 103A to 103D are replaceable with a contact-type charger using a charging brush or with a noncontact-type charging device. The exposure unit E has a not-shown semiconductor laser, a polygon mirror 4, and reflecting mirrors 8. The exposure unit E shines laser beams modulated depending on the image data for the four colors of black, cyan, magenta, and yellow on the photoreceptor drums 101A to 101D, respectively. Latent images corresponding to the four colors are thus formed on the photoreceptor drums 101A to 101D, respectively.

The developing units 102A to 102D feed the respective surfaces of the photoreceptor drums 101A to 101D carrying the latent images with toners, so that the latent images are developed into toner images. More specifically, the developing units 102A to 102D store therein black, cyan, magenta, and yellow toners, respectively, and develop the latent images formed on the photoreceptor drums 101A to 101D into black, cyan, magenta, and yellow toner images, respectively. The cleaning units 104A to 104D remove and collect residual toners on the respective surfaces of the photoreceptor drums 101A to 101D after developing and transferring processes.

Arranged above the photoreceptor drums 101A to 101D, the intermediate transfer belt 11 is stretched over a drive roller 11A and a driven roller 11B to follow a looped path. As the intermediate transfer belt 11 travels, the outer circumferential surface thereof faces the photoreceptor drum 101D, the photoreceptor drum 101C, the photoreceptor drum 101B and the photoreceptor drum 101A, in that order. The first transfer rollers 13A to 13D are positioned to face the photoreceptor drums 101A to 101D, respectively, through the intermediate transfer belt 11. First transfer regions of the present invention include the first transfer rollers 13A to 13D and the photoreceptor drums 101A to 101D, respectively. In the respective first transfer regions, a tone image is transferred from the drums 101A to 101D to the intermediate transfer belt 11.

The intermediate transfer belt 11 is an endless belt formed with a film of 100 μm to 150 μm thickness. The intermediate transfer belt 11 has a resistance of $10^{11}$ to $10^{13}$ Ω·cm. A lower resistance causes power leakage from the intermediate transfer belt 11, thereby preventing transfer power sufficient for the first transfer processes from being maintained. A higher resistance requires a discharging device for discharging the intermediate transfer belt 11 each time after the belt 11 passes through the respective first transfer regions.

To the first transfer rollers 13A to 13D, a first transfer bias (or transfer power of the present invention) is applied at a constant voltage for transferring the toner images as carried on the photoreceptor drums 101A to 101D onto the intermediate transfer belt 11. The first transfer bias is opposite in polarity to the charge of the toners. The toner images for the respective colors are thus transferred sequentially and accumulated on the outer circumferential surface of the intermediate transfer belt 11 to form a full-color toner image.

When image data for only some of the four colors are input, latent image(s) and toner image(s) are formed only on some of the photoreceptor drums 101A to 101D, depending on the input color image data. In a monochromatic image formation, for example, a latent image and a toner image are formed only on the photoreceptor drum 101A corresponding to the color black. Accordingly, only a black toner image is transferred to the outer circumferential surface of the intermediate transfer belt 11.

Each of the first transfer rollers 13A to 13D includes a metal (e.g. stainless steel) shaft of 8 to 10 mm diameter. A surface of the metal shaft is coated with conductive elastic material (e.g. EPDM or urethane foam), through which a high voltage is uniformly applied to the intermediate transfer belt 11. The first transfer rollers 13A to 13D are replaceable with brush-type transfer members.

In addition, the first transfer rollers 13A to 13D are biased toward the photoreceptor drums 101A to 101D, respectively, in a direction other than respective normal directions of the photoreceptor drums 101A to 101D.

The rotation of the intermediate transfer belt 11 feeds the full-color or monochromatic toner image as transferred to the outer circumferential surface of the belt 11 to a region where the belt 11 faces the second transfer roller 14 (i.e. a second transfer region of the present invention). In an image formation, the second transfer roller 14 is pressed at a predetermined nip pressure against the outer circumferential surface of the intermediate transfer belt 11 where a reverse, inner circumferential surface of the belt 11 is in contact with the drive roller 11A. A high voltage opposite in polarity to the charge of the toners is applied to a sheet as fed from the sheet feed cassette 16 or the manual sheet feed tray 17 as the sheet passes between the second transfer roller 14 and the intermediate transfer belt 11. The full-color or monochromatic toner image is thus transferred from the outer circumferential surface of the intermediate transfer belt 11 to a surface of the sheet.

To maintain the predetermined nip pressure, either one of the second transfer roller 14 and the drive roller 11A is a roller of hard material (i.e. metal), and the other is an elastic roller of soft material (i.e. elastic rubber or resin foam).

In some instances, some of the toners are not transferred to the sheet and remain on the intermediate transfer belt 11. The residual toners are collected by a cleaning unit 12 to avoid mixture of toners of different colors in a subsequent image formation.

The sheet with the full-color or monochromatic toner image transferred thereto is led into the fusing device 15 and passes between a heat roller 15A and a pressure roller 15B to be heated and pressed. The toner image is thus firmly fixed to the surface of the sheet. The sheet with the fixed toner image is then ejected onto the sheet catch tray 18 by sheet eject rollers 18A.

The image forming apparatus 100 has the sheet transport path P1 leading approximately vertically from the sheet feed cassette 16, through a gap between the second transfer roller 14 and the intermediate transfer belt 11 and through the fusing device 15, to the sheet catch tray 18. Arranged along the sheet transport path P1 are a pick-up roller 16A, transport rollers R, registration rollers 19, and the sheet eject rollers 18A. The pick-up roller 16A feeds sheets as stored in the sheet feed cassette 16, sheet by sheet, into the sheet transport path P1. The transport rollers R transport a fed sheet upward. The registration rollers 19 lead the sheet between the second transfer roller 14 and the intermediate transfer belt 11 at a predetermined timing. The sheet eject rollers 18A eject the sheet onto the sheet catch tray 18.

The image forming apparatus 100 also has the sheet transport path P2 leading from the manual sheet feed tray 17 to the registration rollers 19. A pick-up roller 17A and transport rollers R are arranged along the sheet transport path P2. Also provided is the sheet transport path P3 leading from the sheet eject rollers 18A to upstream of the registration rollers 19 on the sheet transport path P1.

The sheet eject rollers 18A are rotatable in forward and backward directions. In a single-side image formation, and in an image formation on a second side of a sheet in a double-side image formation, the sheet eject rollers 18A are rotated in the forward direction, so that the sheet is ejected onto the sheet catch tray 18. In an image formation on a first side of the sheet in the double-side image formation, the sheet eject rollers 18A are first rotated in the forward direction until a tail end of the sheet passes through the fusing device 15. Then, with the tail end nipped therebetween, the eject rollers 18A are rotated in the backward direction to feed the sheet into the sheet transport path P3. Thus, in the double-side image formation, the sheet having an image formed on the first side thereof is fed into the sheet transport path P1, the tail end first, with the second side facing the side of the drive roller A.

The registration rollers 19 feed a sheet as fed either from the sheet feed cassette 16 or the manual sheet feed tray 17, or through the sheet transport path P3, between the second transfer roller 14 and the intermediate transfer belt 11 in synchronized timing with the rotation of the intermediate transfer belt 11. The registration rollers 19 have their own rotation stopped at the time the photoreceptor drums 101A to 101D and the intermediate transfer belt 11 start rotating. A sheet as fed or transported before the intermediate transfer belt 11 starts rotating is stopped, with a leading end thereof in contact with the registration rollers 19. Then, as the leading end of the sheet and a leading end of the toner image formed on the intermediate transfer belt 11 meet each other at the contact position of the second transfer roller 14 and the intermediate transfer belt 11, the registration rollers 19 start rotating.

Figure 3:
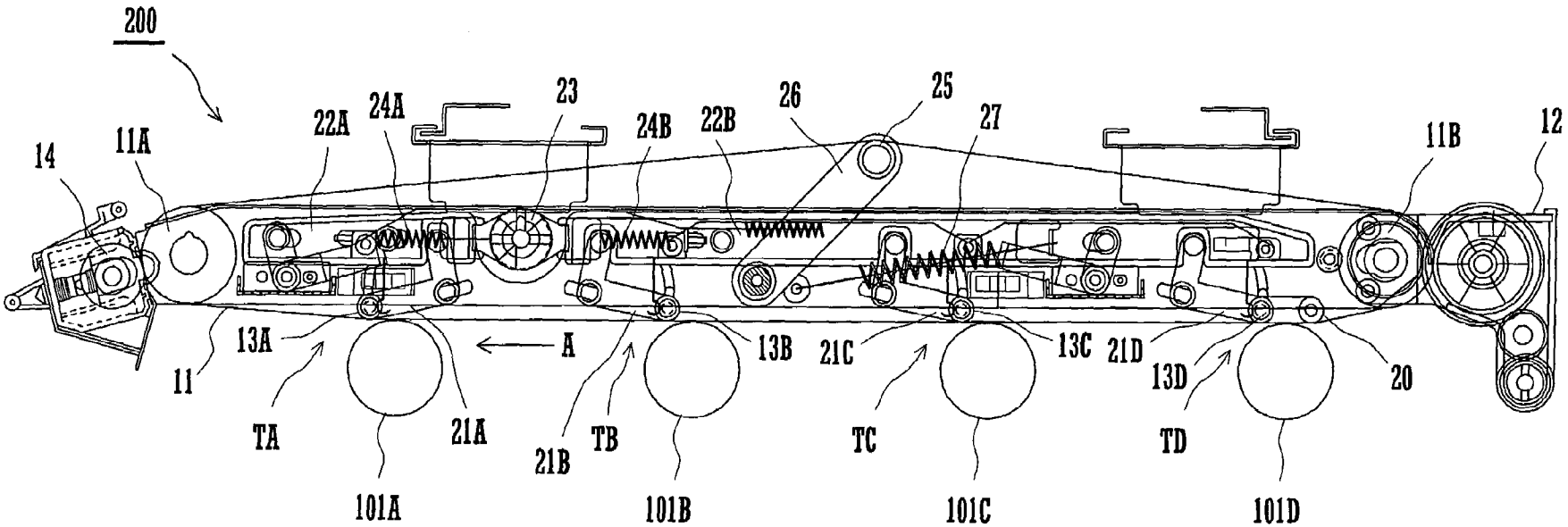
FIG. 3 is a front view illustrating a construction of the transfer device according to the embodiment.

FIG. 3 is a front view illustrating the construction of the transfer device according to the embodiment of the present invention. In the transfer device, first transfer regions TA to TD are provided in a lower portion of the loop traveling path of the intermediate transfer belt 11 as stretched over the drive roller 11A and the driven roller 11B. The second transfer roller 14 is positioned immediately downstream of the first transfer roller 13A that is arranged most downstream in a traveling direction, as indicated by an arrow A, of the intermediate transfer belt 11.

This positioning is aimed at achieving high-speed image formation as well as at downsizing the image forming apparatus in which a toner image is secondly transferred from the intermediate transfer belt 11 to a sheet as transported approximately vertically. The high-speed image formation is allowed by reducing time taken from the initiation of first transfer process by the first transfer roller 13D positioned most upstream, to the completion of second transfer process by the second transfer roller 14.

In the first transfer regions TA to TD, the first transfer rollers 13A to 13D are provided downstream of respective contact positions of the intermediate transfer belt 11 and the photoreceptor drums 101A to 101D so that the rollers 13A to 13D are in contact with the intermediate transfer belt 11 but out of contact with the photoreceptor drums 101A to 101D, respectively, through the belt 11. The intermediate transfer belt 11 is pressed by the first transfer rollers 13A to 13D so as to be in contact with the photoreceptor drums 101A to 101D, respectively.

The first transfer rollers 13A to 13D are supported rotatably by swingable supports 21A to 21D, respectively. The support 21A is fastened at an upper end thereof to a movable member 22A. The supports 21B to 21D are fastened at respective upper ends thereof to a movable member 22B. The movable members 22A and 22B are rendered horizontally reciprocable by a cam 23 and springs 24A and 24B. The horizontal movements of the movable members 22A and 22B allow the supports 21A to 21D to swing, so that the first transfer roller 13A independently, and the first transfer rollers 13B to 13D integrally, are moved close to or away from the photoreceptor drums 101A to 101D, respectively.

In full-color image formation, the first transfer process is performed in all of the first transfer regions TA to TD. Accordingly, the first transfer rollers 13A to 13D are positioned downwards close to the photoreceptor drums 101A to 101D, respectively, so that the intermediate transfer belt 11 is in contact with all of the photoreceptor drums 101A to 101D. In monochromatic image formation, the first transfer process is only performed in the first transfer region TA. Accordingly, only the first transfer roller 13A is positioned downwards close to the photoreceptor drum 101A, so that the intermediate transfer belt 11 is in contact with the photoreceptor drum 101A only. In standby time when no image formation is performed, the first transfer rollers 13A to 13D are all positioned upwards away from the photoreceptor drums 101A to 101D, respectively, so that the intermediate transfer belt 11 is out of contact with any of the photoreceptor drums 101A to 101D.

Figure 4A:
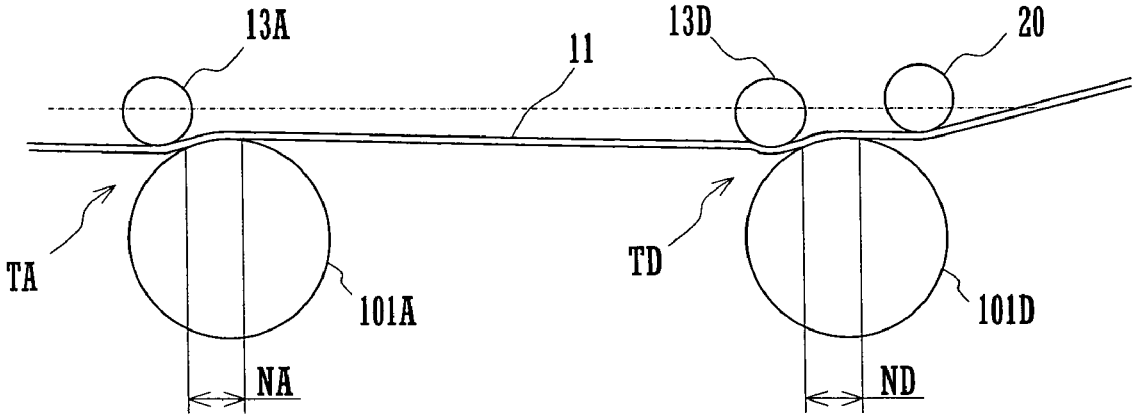
FIG. 4A is a diagram illustrating how a pressure member works in the transfer device.
Figure 4B:
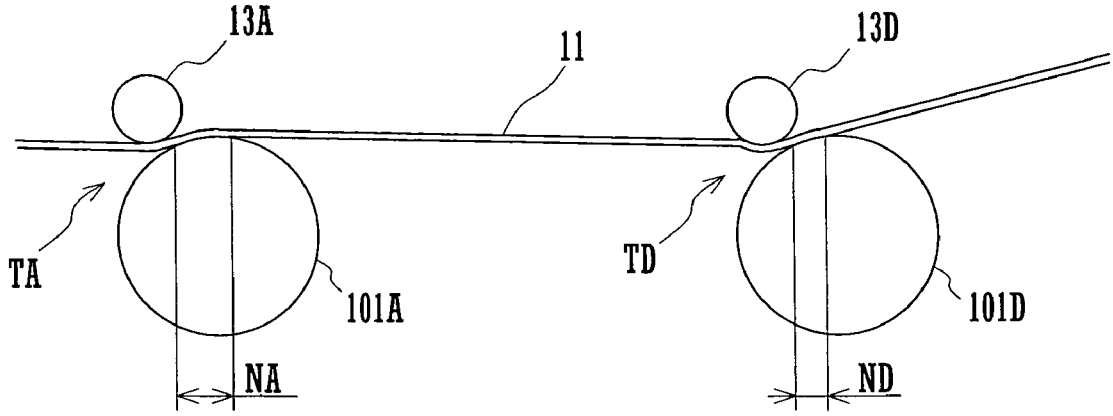
PRIOR ART FIG. 4B
FIG. 4B is a diagram illustrating a state in which the pressure member is not provided in the transfer device.

Illustrated in FIG. 4A is a state in which the full-color image formation is being performed. In FIGS. 4A and 4B, only the first transfer regions TA and TD are illustrated. The first transfer regions TB and TC, which are similar to the position TA, are omitted for the purpose of simplification. In the full-color image formation, respective centers of the first transfer rollers 13A to 13D are on a level line as indicated by a dotted-dashed line. Bottommost portions of the circumferences of the first transfer rollers 13A to 13D are positioned below uppermost portions of the circumferences of the photoreceptor drums 101A to 101D, respectively.

In the first transfer regions TA to TD, therefore, portions of the intermediate transfer belt 11 downstream of the respective contact positions of the belt 11 and the photoreceptor drums 101A to 101D are pressed by the first transfer rollers 13A to 13D, respectively, so as to be in contact with the drums 101A to 101D. Portions of the intermediate transfer belt 11 upstream of the respective contact positions are pressed by the first transfer rollers 13B to 13D in the respective first transfer regions TB to TD upstream of the first transfer regions TA to TC so as to be in contact with the drums 101A to 101C. The intermediate transfer belt 11 is thus brought into contact with each of the photoreceptor drums 101A to 101C over a predetermined traveling distance, so that a transfer nip area of the same width is formed in each of the first transfer regions TA to TC.

Also, a lower portion of the loop traveling path of the intermediate transfer belt 11 is deformed as the first transfer rollers 13A to 13D are moved depending on the full-color image formation, the monochromatic image formation, and the standby time. Accordingly, a tension roller 25 is displaced up and down to maintain a constant tension of the intermediate transfer belt 11. The tension roller 25 is supported by a first end of a lever 26. The lever 26 has a spring 27 fastened to a second end thereof.

Without a pressure roller 20 (to be described below) provided, as shown in FIG. 4B, a portion of the intermediate transfer belt 11 upstream of the contact position of the belt 11 and the photoreceptor drum 101D is not pressed and is thus out of contact with the drum 101D in the first transfer region TD positioned most upstream. Therefore, the first transfer region TD has a transfer nip width ND narrower than transfer nip widths NA to NC that the first transfer regions TA to TC have, respectively. This causes a discrepancy in transfer result between the first transfer region TD and the first transfer regions TA to TC.

In the transfer device 200 according to the present embodiment, the pressure roller 20 is supported rotatably by the support 21D that supports the first transfer roller 13D in the first transfer region TD as positioned most upstream. The pressure roller 20 is a pressure member of the present invention. The pressure roller 20 is formed to have the same overall diameter as each of the first transfer rollers 13A to 13D.

The pressure roller 20 has an outer circumferential surface of insulating material, for example, thereby preventing the intermediate transfer belt 11 from being grounded therethrough. This is because if first transfer voltage applied to the intermediate transfer belt 11 through the first transfer roller 13D is grounded through the pressure roller 20, an electric field sufficient for first transfer process of a toner image is not produced in the first transfer region TD.

The pressure roller 20 is arranged upstream of the contact position of the intermediate transfer belt 11 and the photoreceptor drum 101D so that the roller 20 is in contact with the intermediate transfer belt 11 but out of contact with the photoreceptor drum 101D through the belt 11. Since the pressure roller 20 is supported by the support 21D, the pressure roller 20 is allowed to be moved together with the first transfer roller 13D close to or away from the photoreceptor drum 101D.

As illustrated in FIG. 4A, in the full-color image formation where the first transfer roller 13D is positioned downwards close to the photoreceptor drum 101D, the pressure roller 20 is also positioned downwards close to the drum 101D. At this time, the pressure roller 20 presses a portion of the intermediate transfer belt 11 upstream of the contact position of the belt 11 and the photoreceptor drum 101D so that the portion is in contact with the drum 101D. A bottommost portion of the circumference of the pressure roller 20 is positioned at such a level that the first transfer region TD has a transfer nip width ND the same as the respective transfer nip widths NA to NC that the first transfer regions TA to TC have.

In the first transfer region TD as well, therefore, the portion of the intermediate transfer belt 11 upstream of the contact position is pressed by the pressure roller 20 so as to be in contact with the drum 101D. The first transfer regions TA to TD thus have the respective transfer nip areas of the same width formed between the intermediate transfer belt 11 and the photoreceptor drums 101A to 101D, respectively, thereby producing uniform transfer results.

It is to be noted that the pressure roller 20 need not have the same diameter as the first transfer rollers 13A to 13D nor be supported by the support 21D that supports the first transfer roller 13D, as long as the first transfer region TD has the transfer nip width ND the same as the respective transfer nip widths NA to NC that the first transfer regions TA to TC have.

It is also to be noted that the pressure roller 20 is replaceable with a non-rotational pressure member, as long as there is a sufficiently low friction resistance between the pressure member and the intermediate transfer belt 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transfer device, comprising:

an endless intermediate transfer belt following a loop path in a predetermined traveling direction;

a plurality of image carriers;

a plurality of first transfer rollers arranged in first transfer regions where the intermediate transfer belt is pressed by the first transfer rollers and brought into contact with the image carriers in order for a toner image to be firstly transferred from the image carriers to the intermediate transfer belt, the first transfer rollers being movably supported by a support close to or away from the image carriers in the respective first transfer regions;

a second transfer roller arranged in a second transfer region where the toner image is secondly transferred from the intermediate transfer belt to a record medium fed between the second transfer roller and the intermediate transfer belt, the second transfer region being provided downstream of the first transfer regions in the traveling direction; and a pressure member supported by the support that supports the first transfer roller in the first transfer region most upstream in the traveling direction, wherein the pressure member is a roller provided upstream of the most upstream one of the image carriers in the traveling direction for pressing the intermediate transfer belt upstream of and against the most upstream one of the image carriers in the traveling direction so as to allow a portion of the intermediate transfer belt between an initial contact point with the most upstream one of the image carriers in the traveling direction and a final contact point with the pressure member to be parallel with respective portions of the intermediate transfer belt located between an initial contact point with each one of the remaining image carriers and a final contact point with an immediately upstream one of the first transfer rollers in the traveling direction.

2. A transfer device according to claim 1, wherein in the respective first regions the first transfer rollers are arranged downstream of the image carriers in the traveling direction to be out of contact with the image carriers through the intermediate transfer belt.

3. A transfer device according to claim 1, wherein the intermediate transfer belt is ungrounded through the pressure member.

* * * * *